US010570538B2

(12) United States Patent
Kolmes et al.

(10) Patent No.: US 10,570,538 B2
(45) Date of Patent: Feb. 25, 2020

(54) CUT, SLASH AND/OR ABRASION RESISTANT PROTECTIVE FABRIC AND LIGHTWEIGHT PROTECTIVE GARMENT MADE THEREFROM

(75) Inventors: Nathaniel H. Kolmes, Hickory, NC (US); Fred Elton Driver, Ronda, NC (US); Walter Gordon Schulein, Little Egg Harbor, NJ (US)

(73) Assignee: Nathaniel H. Kolmes, Hickory, NC (US)

( * ) Notice: Subject to any disclaimer, the term of this patent is extended or adjusted under 35 U.S.C. 154(b) by 135 days.

(21) Appl. No.: 11/439,273

(22) Filed: May 24, 2006

(65) Prior Publication Data

US 2007/0271965 A1 Nov. 29, 2007

(51) Int. Cl.
*D04B 1/22* (2006.01)

(52) U.S. Cl.
CPC ..... *D04B 1/22* (2013.01)

(58) Field of Classification Search
CPC ..... A41D 13/08; A41D 13/081; A41D 13/05; A41D 31/24; D04B 1/14; D04B 1/16; D04B 1/28; D04B 1/22; D02G 3/442
USPC ..... 66/170, 169 R, 171, 174, 202; 2/16, 21, 2/22
See application file for complete search history.

(56) References Cited

U.S. PATENT DOCUMENTS 3,078,699 A * 2/1963 Huntley ..... 66/176
4,055,201 A * 10/1977 Fowler et al. ..... 139/421
4,143,197 A * 3/1979 Jasionowicz et al. ..... 442/49
4,384,449 A * 5/1983 Byrnes et al. ..... 57/210
4,467,476 A * 8/1984 Herbert ..... 2/2.5
4,470,251 A * 9/1984 Bettcher ..... 57/230
4,497,069 A * 2/1985 Braunhut ..... 2/2.5
4,777,789 A * 10/1988 Kolmes et al. ..... 57/210
4,825,470 A 5/1989 Horio
4,838,017 A * 6/1989 Kolmes et al. ..... 57/210
4,856,110 A * 8/1989 Giesick ..... 2/22
4,936,085 A * 6/1990 Kolmes et al. ..... 57/229
5,060,314 A * 10/1991 Lewis ..... 2/2.5
5,072,453 A * 12/1991 Widder ..... 2/2.5
5,119,512 A * 6/1992 Dunbar et al. ..... 2/167
5,177,948 A * 1/1993 Kolmes et al. ..... 57/229
5,382,264 A 1/1995 Sharma
(Continued)

FOREIGN PATENT DOCUMENTS

JP 62-299590 12/1987
JP 63-254030 10/1988
(Continued)

OTHER PUBLICATIONS

U.S. Appl. No. 12/206,834, filed Sep. 9, 2008, Schulein, et al.
(Continued)

*Primary Examiner* — Danny Worrell
(74) *Attorney, Agent, or Firm* — Oblon, McClelland, Maier & Neustadt, L.L.P.

(57) ABSTRACT

A cut, slash and/or abrasion resistant fabric is provided having both high cut resistance and light fabric weight, preferably a cut resistance of at least 500 (as measured by ASTM-F1790-04) and a fabric weight of no more than 27.9 ounces/square yard (OPSY), which can be prepared, if desired, by shaped knitting into a shaped fabric panel, which is used to prepare cut, slash and/or abrasion resistant garments or coverings.

8 Claims, 3 Drawing Sheets

(56) References Cited

U.S. PATENT DOCUMENTS

| | | | | |
|---|---|---|---|---|
| 5,423,168 | A | 6/1995 | Kolmes et al. | |
| 5,442,815 | A * | 8/1995 | Cordova et al. | 2/161.7 |
| 5,495,621 | A * | 3/1996 | Kibbee | 2/2.5 |
| 5,500,025 | A | 3/1996 | Sharma | |
| 5,584,737 | A * | 12/1996 | Luhtala | 441/107 |
| 5,628,172 | A * | 5/1997 | Kolmes et al. | 57/210 |
| 5,632,137 | A * | 5/1997 | Kolmes et al. | 57/212 |
| 5,644,907 | A * | 7/1997 | Kolmes et al. | 57/230 |
| 5,655,358 | A * | 8/1997 | Kolmes | 57/212 |
| 5,673,836 | A * | 10/1997 | Bush | 224/576 |
| 5,717,999 | A * | 2/1998 | Lurry | 2/69 |
| 5,718,000 | A * | 2/1998 | Ost et al. | 2/69 |
| 5,754,982 | A * | 5/1998 | Gainer | 2/2.5 |
| 5,845,476 | A * | 12/1998 | Kolmes | 57/229 |
| 5,858,054 | A * | 1/1999 | Rosen | 66/202 |
| 5,894,600 | A * | 4/1999 | Chenefront | 2/69 |
| 5,965,223 | A * | 10/1999 | Andrews et al. | 428/34.5 |
| 6,029,270 | A * | 2/2000 | Ost et al. | 2/2.5 |
| 6,155,084 | A * | 12/2000 | Andrews et al. | 66/174 |
| 6,158,056 | A * | 12/2000 | Riley | 2/269 |
| 6,182,288 | B1 * | 2/2001 | Kibbee | 2/2.5 |
| 6,185,745 | B1 * | 2/2001 | Alger | 2/107 |
| 6,212,914 | B1 * | 4/2001 | Kolmes et al. | 66/172 R |
| 6,230,524 | B1 * | 5/2001 | Kolmes et al. | 66/172 R |
| 6,263,509 | B1 * | 7/2001 | Bowen | 2/69 |
| 6,341,483 | B1 * | 1/2002 | Kolmes et al. | 57/249 |
| 6,349,531 | B1 * | 2/2002 | Kolmes et al. | 57/229 |
| 6,351,932 | B1 | 3/2002 | Hummel | |
| 6,363,703 | B1 * | 4/2002 | Kolmes | 57/210 |
| 6,367,290 | B2 * | 4/2002 | Kolmes et al. | 66/172 R |
| 6,381,940 | B1 * | 5/2002 | Kolmes et al. | 57/245 |
| 6,467,251 | B1 | 10/2002 | Kolmes | |
| RE38,136 | E | 6/2003 | Kolmes | |
| 6,698,024 | B2 * | 3/2004 | Graves et al. | 2/2.5 |
| 6,892,392 | B2 * | 5/2005 | Crye et al. | 2/2.5 |
| 6,918,241 | B2 * | 7/2005 | Zhu | 57/225 |
| 7,111,445 | B2 | 9/2006 | Threlkeld et al. | |
| 7,121,077 | B2 * | 10/2006 | Andrews et al. | 57/210 |
| 7,178,323 | B2 | 2/2007 | Kolmes et al. | |
| 7,214,425 | B2 | 5/2007 | Kolmes et al. | |
| 2005/0086924 | A1 | 4/2005 | Kolmes | |
| 2005/0186259 | A1 | 8/2005 | Threlkeld et al. | |
| 2006/0088712 | A1 | 4/2006 | Threlkeld et al. | |
| 2007/0094761 | A1 | 5/2007 | Kolmes et al. | |
| 2007/0099528 | A1 | 5/2007 | Kolmes et al. | |
| 2007/0137164 | A1 | 6/2007 | Kolmes et al. | |
| 2007/0144135 | A1 | 6/2007 | Kolmes et al. | |

FOREIGN PATENT DOCUMENTS

| | | |
|---|---|---|
| JP | 6-65830 | 3/1994 |
| JP | 2002-54042 | 2/2002 |
| JP | 2002-266118 | 9/2002 |
| JP | 2003-147651 | 5/2003 |
| JP | 2003-306817 | 10/2003 |
| JP | 2006-169656 | 6/2006 |

OTHER PUBLICATIONS

U.S. Appl. No. 12/538,218, filed Aug. 10, 2009, Schulein, et al.
U.S. Appl. No. 12/551,736, filed Sep. 1, 2009, Kolmes, et al.
Office Action dated May 22, 2012, in Japanese Patent Application No. 20090512232, filed May 18, 2007 w/English-language translation.
U.S. Appl. No. 14/023,977, filed Sep. 11, 2013, Kolmes, et al.
Office Action dated Jun. 27, 2013 in Canadian Patent Application No. CA20072647443, filed May 18, 2007.
Supplementary European Search Report dated Nov. 3, 2014 in European Patent Application No. 07797580.3, filed May 18, 2007.
Office Action dated Sep. 21, 2015 in Mexican Patent Application No. MX/a/2008/014871.
Office Action dated Feb. 28, 2017 in Japanese Patent Application No. 2015-226815, filed Nov. 19, 2015 w/English translation.
Office Action dated Nov. 13, 2018, in European Patent Application No. 20070797580, filed May 18, 2007.
Office Action dated Mar. 21, 2018, in European Patent Application No. 20070797580, filed May 18, 2007.
U.S. Appl. No. 10/972,332, filed Oct. 26, 2004, U.S. Pat. No. 2006/0088712 A1, Threlkeld, et al.
U.S. Appl. No. 10/693,971, filed Oct. 8, 2003, US2005/0086924 A1, Kolmes.
U.S. Appl. No. 10/785,060, filed Feb. 25, 2004, US2005/0186259 A1, Threlkeld, et al.
U.S. Appl. No. 60/730,829, filed Oct. 28, 2005, Kolmes.
U.S. Appl. No. 11/251,928, filed Oct. 18, 2005, US2007/00994761 A1, Kolmes, et al.
U.S. Appl. No. 11/263,851, filed Nov. 2, 2005, US2007/0099528 A1, Kolmes, et al.
U.S. Appl. No. 11/589,210, filed Oct. 30, 2006, US2007/0144135 A1, Kolmes, et al.
U.S. Appl. No. 11/679,341, filed Feb. 27, 2007, US2007/0137164 A1, Kolmes, et al.
U.S. Appl. No. 11/778,340, filed Jul. 16, 2007, Schulein.
U.S. Appl. No. 61/020,790, filed Jan. 14, 2008, Kolmes, et al.
U.S. Appl. No. 12/134,446, dated Jun. 6, 2008, Kolmes, et al.
Japanese Office Action issued Jan. 14, 2020 in Japanese Application No. 2018-242345, filed Dec. 26, 2018.

* cited by examiner

CUT, SLASH AND/OR ABRASION RESISTANT PROTECTIVE FABRIC AND LIGHTWEIGHT PROTECTIVE GARMENT MADE THEREFROM

BACKGROUND OF THE INVENTION

1. Field of the Invention

The present invention relates to a lightweight protective fabric that is cut, slash and/or abrasion resistant, and garments made therefrom.

2. Discussion of the Background

In many industries and professions there is a need for protective wear that is cut and/or abrasion resistant, yet lightweight and comfortable for the wearer. From maintenance workers crawling through HVAC ventilation shafts to weekend warriors participating in various sporting events, many individuals need protection from cuts and scrapes as they go about their daily activities.

Typical examples of previous garments and modular systems are disclosed in U.S. Publication No. 2004/0199983 to Gillen; U.S. Pat. No. 6,892,392 to Crye; U.S. Pat. No. 6,698,024 to Graves; U.S. Pat. No. 6,263,509 to Bowen; U.S. Pat. No. 6,185,745 to Alger; U.S. Pat. No. 6,182,288 to Kibbee; U.S. Pat. No. 6,158,056 to Riley; U.S. Pat. No. 6,029,270 to Ost; U.S. Pat. No. 5,894,600 to Chenefront; U.S. Pat. No. 5,754,982 to Gainer; U.S. Pat. No. 5,718,000 to Ost; U.S. Pat. No. 5,717,999 to Lurry; U.S. Pat. No. 5,673,836 to Bush; U.S. Pat. No. 5,584,737 to Luhtala; U.S. Pat. No. 5,495,621 to Kibbee; U.S. Pat. No. 5,072,453 to Widder; U.S. Pat. No. 5,060,314 to Lewis; U.S. Pat. No. 4,497,069 to Braunhut; and U.S. Pat. No. 4,467,476 to Herbert, the disclosures of which are incorporated by reference herein in their entirety.

However, these and other known such garments suffer from numerous disadvantages. The garments are often unable to provide a satisfactory level of protection to a wearer of the garment, are easily damaged, are unwieldy and uncomfortable to the wearer, do not permit airflow therethrough, do not permit the escape of excess water vapor from the skin of the wearer, and often require the use of specialized over- or undergarments. Most of the modular systems in these patents require a central vest portion to be present in order to attach the other parts of the system.

An additional difficulty in preparing cut, slash and abrasion resistant fabrics and garments, is that in order to achieve sufficient cut and slash protection using high-performance fibers, the garments typically end up being too bulky, too heavy, and are difficult to put together, as the fabric cannot be readily cut to necessary size and shape without taking a high toll on the cutting apparatus.

Thus there is a need for a fabric that is cut, slash and/or abrasion resistant, while remaining lightweight. There is also a need for a method for preparing garments or coverings from such fabrics and the garments and coverings made therefrom.

SUMMARY OF THE INVENTION

It is an object of the present invention to overcome these or other disadvantages of known cut, slash and/or abrasion resistant fabrics.

It is a further object of the present invention to provide a method to prepare a cut, slash and/or abrasion resistant garment or covering that is able to provide a satisfactory level of cut, slash and/or abrasion resistance protection to the wearer, able to resist damage, is light-weight, comfortable, able to permit airflow therethrough, able to permit the escape of excess water vapor from the skin of the wearer, able to be worn directly against the skin as an undergarment, and able to be worn under street clothes or a uniform without the use of specialized over- or undergarments.

These and other objects of the present invention can be provided by a shaped knit fabric panel, comprising at least one cut, slash and/or abrasion resistant yarn, wherein the shaped knit fabric panel has a cut resistance of at least 500 (as measured by ASTM-F1790-04) and a fabric weight of no more than 27.9 ounces/square yard (OPSY), and the use of one or more shaped knit fabric panels to prepare a garment or covering that provides the same cut resistance and lightweight comfort.

BRIEF DESCRIPTION OF THE DRAWINGS

A more complete appreciation of the present invention, and many of the attendant advantages thereof, will be readily ascertained and obtained as the same becomes better understood by reference to the following detailed description when considered in connection with the accompanying drawings, wherein.

DETAILED DESCRIPTION OF THE INVENTION

Figure 1:
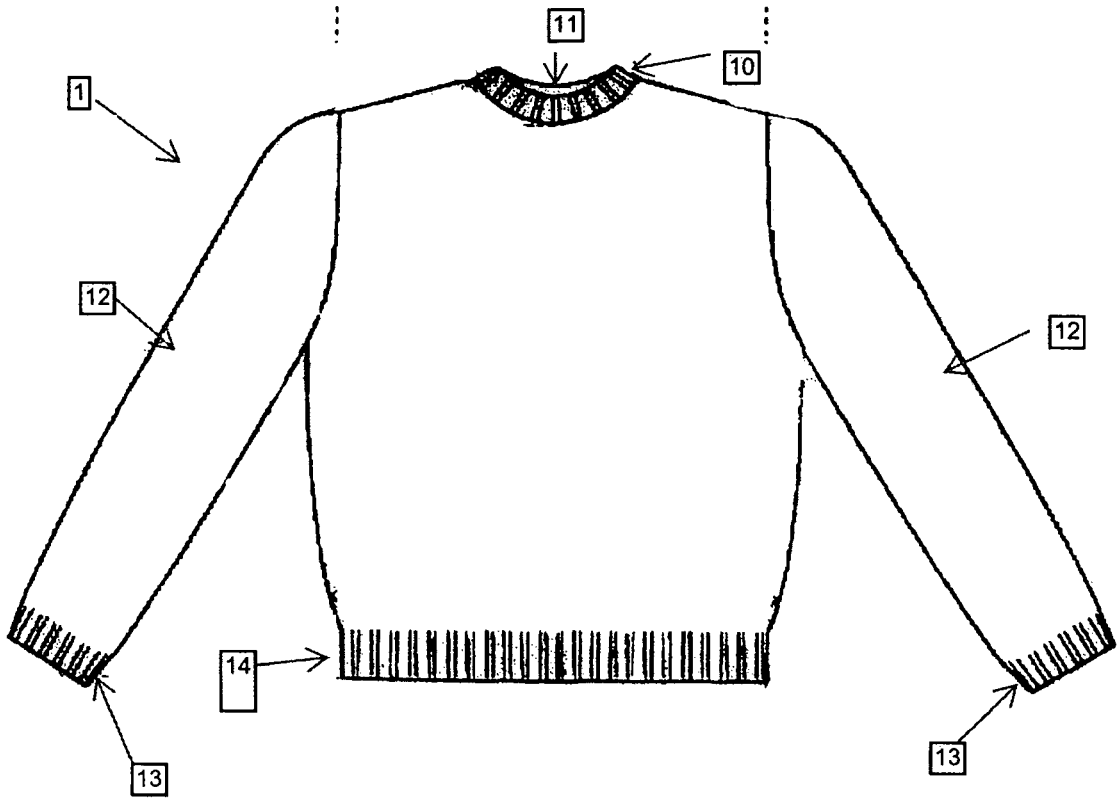
FIG. 1 is an exemplary embodiment of a sweater according to the present invention.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

The term "composite yarn" (or "engineered yarn") refers to a yarn prepared from two or more yarns (or "ends"), which can be the same or different. Composite yarn can occur in a variety of forms wherein the two or more ends are in differing orientations relative to one another, so long as the final composite yarn containing the two or more ends is stably assembled (i.e. will remain intact unless forcibly separated or disassembled). The two or more ends can, for example, be parallel, wrapped one around the other(s), twisted together, or combinations of any or all of these, as well as other orientations, depending on the properties of the composite yarn desired. Suitable composite yarns, which may be formed into fabric by any desired process, preferably knit or woven into the fabric, include, but are not limited to, those as described in U.S. Pat. Nos. 4,777,789, 4,838,017, 4,936,085, 5,177,948, 5,628,172, 5,632,137, 5,644,907, 5,655,358, 5,845,476, 6,212,914, 6,230,524, 6,341,483, 6,349,531, 6,363,703, 6,367,290, and 6,381,940, each to Kolmes, the contents of each of which are hereby incorporated by reference. Another term by which composite yarns are known is "engineered yarn".

The present invention relates to a shaped knit protective fabric panel having a cut resistance of at least 500, according to the ASTM-F1790-04 (Standard Cut Test on Composite Yarn), and a fabric weight of 27.9 ounces/sq. yd or less, and protective garments and coverings made therefrom.

The fabric panel of the present invention comprises sufficient cut, slash and/or abrasion resistant yarn to provide the fabric with the necessary level of cut resistance, such that the fabric has a cut resistance of at least 500 as measured by ASTM-F1790-04, the Standard Cut Test on Composite Yarn, the entire contents of which are hereby incorporated by reference. These cut, slash and/or abrasion resistant yarns can be any high performance yarn, a composite yarn, a yarn blend comprising one or more high performance or composite yarns, etc. Suitable high-performance yarns include, but are not limited to, extended chain polyethylene (such as SPECTRA or DYNEEMA), aramids (such as KEVLAR), and liquid crystalline polyesters (such as VECTRAN). The fabric preferably has a cut resistance of from 500 to 6200, more preferably from 1000 to 6200. The fabric preferably may contain one or more composite yarns, either alone or in combination with any other natural or synthetic fiber. Such natural or synthetic fibers include, but are not limited to, cotton, wool, nylon, polyester, rayon, cellulose acetate, etc.

The fabric of the present invention further has a fabric weight that is sufficiently lightweight to be practical for wearing, having a fabric weight of no more than 27.9 ounces/square yard (OPSY), preferably a fabric weight of from 7 to 27.9 OPSY, more preferably from 8 to 20 OPSY, most preferably from 8 to 17 OPSY.

The protective garments of the present invention are made from the protective fabric and can be any form of garment, including, but not limited to, shirts, socks, sweaters, vests, undergarments, pants, jumpsuits, dickeys, and head coverings. The protective garment of the present invention can provide one or more of the following advantages, including the prevention or reduction of injury to the wearer, resistance to damage, and light-weight construction. In a preferred embodiment of the invention, the protective garment comprises a fabric made entirely from cut, slash and/or abrasion resistant composite yarns. The garments are made according to any known method useful for preparing garments from fabrics. Preferably, the garments are made by shaped knitting during preparation of the fabric. Shaped knitting is a process by which the various panels of a garment are formed directly in the shape needed for assembly, during the knitting process. This is preferred for the present invention, since the fabrics of the present invention have cut and slash resistance and are therefore extremely difficult to cut using conventional fabric cutting means. While it is possible to cut the fabric, the cutting process is very hard on the cutting surfaces, significantly reducing the interval between servicing of the cutting equipment, and thus increasing the cost of operations. Accordingly, shaped knitting is preferably used to prepare the panels of fabric which are assembled to prepare the present invention garments. These panels are then linked together to form the garment. Many types of seam construction can be used to attach panels to one another. Since these panels have been shaped during their construction, linking, looping of collars or cup seaming are the most preferred, due to the higher comfort provided by the seam against the wearer's skin as well as strength. The Knit Construction may be in various Gauges such as 3, 4, 5, 6, 7, 8, 10, 12, 13, 14, 16, and 18 gauges wherein within the context of the present invention, the term "gauge" means needles per inch on the specific machine on which the pieces are knit. By way of example, 18 Gauge would normally make a fine textured piece, whereas a 3 gauge piece would normally be of a coarser texture.

In a preferred embodiment, the fabric is prepared into a garment or other type of covering that is seamless. Such garments or coverings can be prepared using a knitting machine such as the "WholeGarment" machine sold by Shima Seiki Mfg., Ltd. of Wakayarna, Japan, or the "Stoll Knit-and-Wear" machinery of H. Stoll & Co. Kg. of Reutlingen, Germany. These garments or coverings could have any desired construction, but would typically be substantially tubular knit in construction, although the tubular construction could have apertures through which appendages could protrude when wearing the garment, or when the covering is applied to an object. The coverings made from the present invention fabrics could be any type of covering, including but not limited to, book covers, wiring protection, sacks, and scuba air hose covers (or socks).

EXAMPLES

As exemplary embodiments, fabrics are made from the following types of yarns:

YARN 1:

Core: Fiberglass #450

Bottom cover: 215 denier SPECTRA wrapped at 9.7 turns per inch (tpi)

Middle cover: 70 denier polyester (PET) wrapped at 18.5 tpi

Top cover: 70 denier polyester (PET) wrapped at 16.3 tpi

YARN 2:

Core 1: Spun polyester 36/1 combined with

Core 2: Fiberglass #225 wrapped by 0.002 in wire at 9.9 tpi, followed by a top cover of 375 denier SPECTRA at 7.8 tpi Cores 1 and 2 being parallel in orientation Bottom cover: 150 denier Polyester (PET) wrapped at 7.5 tpi Top cover: Spun polyester 36/1 wrapped at 5 tpi

YARN 3:

Core 1: 650 denier SPECTRA

Core 2: 3 parallel strands of wire of 0.0035, 0.003 and 0.003 in

Cores 1 and 2 being parallel in orientation

Bottom cover: 1000 denier polyester (PET) wrapped at 9.9 tpi

Top cover: 1000 denier polyester (PET) wrapped at 8.0 tpi

YARN 4:

Core: 70 denier LYCRA T-162C (from DuPont)

Cover: 375 denier SPECTRA wrapped at 7.8 tpi

The resulting fabrics have the cut resistances (measured according to ASTM-F1790-04) and fabric weights shown below:

| Yarn | # of Ends | Standard Cut Test Result | Fabric Weight (OPSY) |
|---|---|---|---|
| YARN 1 | 1 | 1000 | 8.3 |
| YARN 1 | 2 | 1600 | 12.2 |
| YARN 2 | 2 | 3900 | 16.1 |
| YARN 3 | 1 | 6200 | 27.9 |
| YARN 4 | 1 | 525 | 7.3 |

As an example of a garment prepared according to the present invention, FIG. 1 shows an example of a knit sweater construction. The sweater can have any desired measurements, depending on the size of the intended wearer. Such sizes and the needed measurements are well known in the art. For example, a knit sweater (1) as shown in FIG. 1 would typically have a rib (10) around the neck opening (11) approximately 1 inch wide, with a front neck drop of 4-4.75 inches and a back neck drop of about 1 inch. The sleeves (12) would typically have a rib (13) at the end approximately 2.5 inches wide. The bottom of the sweater torso would likewise have a rib (14) of approximately 2.5 inches width.

Figure 2A:
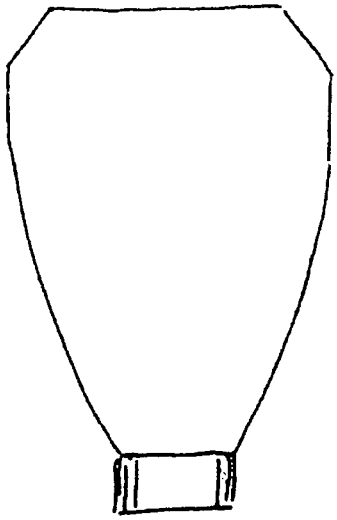
FIGS. 2A-2C show shaped knit fabric panels according to a preferred embodiment of the present invention, as would be used to assemble a sweater according to FIG. 1.
Figure 2C:
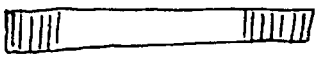
Figure 2B:
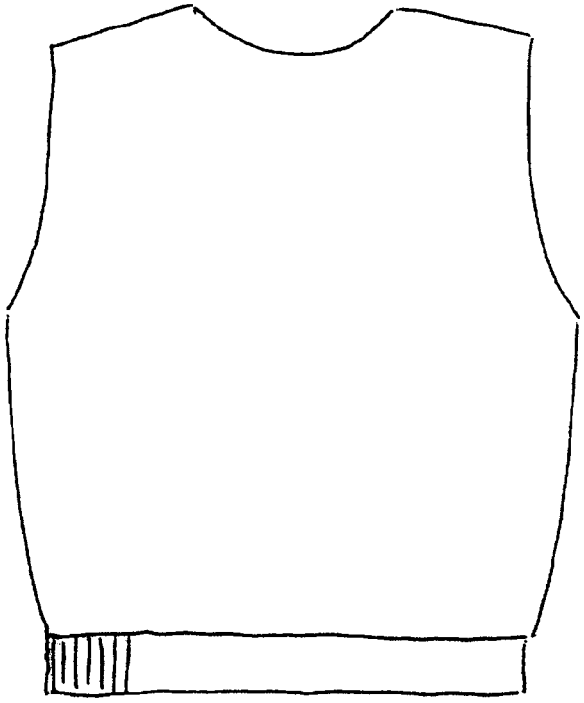

FIGS. 2A-2C show the shaped knit fabric panels that would be used to prepare a preferred embodiment of sweater similar to that in FIG. 1. FIG. 2A shows a shaped knit panel that would be used to prepare the sleeves of a sweater such as in FIG. 1. The sleeve would be formed by joining the right and left edges of the shaped panel in a seam to form a substantially cylindrical sleeve that tapers from one end to the other, with the wider end then being attached to the torso panels. FIG. 2B shows a shaped knit panel that would be used to form a front or back panel of the sweater (with the primary difference being the amount of neck drop). A front panel and back panel would be joined together along the appropriate edges, leaving openings for the neck and sleeves and bottom opening. FIG. 2C shows a knit rib portion that would then be attached to the neck opening formed by joining of the front and back torso panels. The sizes and measurements of the various panels would be readily ascertainable by one of ordinary skill in the knitting and sewing arts.

Numerous additional modifications and variations of the present invention are possible in light of the above teachings. It is therefore to be understood that within the scope of the appended claims, the present invention may be practiced otherwise than as specifically described herein.

The invention claimed is:

1. A cut, slash and/or abrasion resistant garment made from one or more shaped knit fabric panels, wherein the one or more shaped knit fabric panels comprise:

at least one cut, slash and/or abrasion resistant yarn, wherein the shaped knit fabric panel is prepared by shaped knitting and has a cut resistance of at least 500 (as measured by ASTM-F1790-04) and a fabric weight of no more than 27.9 ounces/square yard (OPSY), wherein the shaped knit fabric panel contains no fiberglass containing yarn;

wherein the garment is a member selected from the group consisting of shirts, sweaters, vests, undergarments, pants, jumpsuits, dickeys, and head coverings.

2. The cut, slash and/or abrasion resistant garment of claim 1, wherein the cut resistance is from 500 to 6200.

3. The cut, slash and/or abrasion resistant garment of claim 1, wherein the fabric weight is from 7 to 27.9 OPSY.

4. The cut, slash and/or abrasion resistant garment of claim 1, wherein the at least one cut, slash and/or abrasion resistant yarn is a high performance yarn.

5. The cut, slash and/or abrasion resistant garment of claim 1, wherein the at least one cut, slash and/or abrasion resistant yam is a composite yarn.

6. The cut, slash and/or abrasion resistant garment of claim 1, wherein the cut, slash and/or abrasion resistant garment is made entirely of said one or more shaped knit fabric panels.

7. A cut, slash and/or abrasion resistant garment made from one or more shaped knit fabric panels, wherein the one or more shaped knit fabric panels comprise:

at least one cut, slash and/or abrasion resistant yarn, wherein the at least one cut, slash and/or abrasion resistant yarn is a high performance yarn, and wherein the shaped knit fabric panel is prepared by shaped knitting and has a cut resistance of from 500 to 6200 (as measured by ASTM-F1790-04) and a fabric weight of from 7 to 27.9 ounces/square yard (OPSY), wherein the shaped knit fabric panel contains no fiberglass containing yarn;

wherein the garment is a member selected from the group consisting of shirts, sweaters, vests, undergarments, pants, jumpsuits, dickeys, and head coverings.

8. A cut, slash and/or abrasion resistant garment made from one or more shaped knit fabric panels, wherein the one or more shaped knit fabric panels comprise:

at least one cut, slash and/or abrasion resistant yarn, wherein the at least one cut, slash and/or abrasion resistant yarn is a composite yarn, and wherein the shaped knit fabric panel is prepared by shaped knitting and has a cut resistance of from 500 to 6200 (as measured by ASTM-F1790-04) and a fabric weight of from 7 to 27.9 ounces/square yard (OPSY), wherein the shaped knit fabric panel contains no fiberglass containing yarn;

wherein the garment is a member selected from the group consisting of shirts, sweaters, vests, undergarments, pants, jumpsuits, dickeys, and head coverings.

* * * * *